United States Patent [19]

Jagst

[11] 4,192,042

[45] Mar. 11, 1980

[54] APPARATUS FOR BREAKING TEXTILE FIBER BALES

[75] Inventor: Peter Jagst, Monchengladbach, Fed. Rep. of Germany

[73] Assignee: Trützschler GmbH & Co. KG, Mönchengladbach, Fed. Rep. of Germany

[21] Appl. No.: 885,896

[22] Filed: Mar. 13, 1978

[30] Foreign Application Priority Data

Jul. 20, 1977 [DE] Fed. Rep. of Germany ..... 2732729

[51] Int. Cl.[2] ..... D01G 7/04

[52] U.S. Cl. ..... 19/81; 19/145.5; 241/101 A

[58] Field of Search ..... 19/80 R, 81, 145.5; 241/101 A

[56] References Cited

U.S. PATENT DOCUMENTS 3,251,096 5/1966 Rapp ..... 19/80 R 3,389,435 6/1968 Schwab et al. ..... 19/80 R 3,660,866 5/1972 Jagst ..... 19/81

FOREIGN PATENT DOCUMENTS 669612 10/1964 Italy ..... 19/81

*Primary Examiner*—Louis Rimrodt

*Attorney, Agent, or Firm*—Spencer & Kaye

[57] ABSTRACT

An apparatus for breaking textile fiber bales includes at least two spiked breaker members rotated in the working direction for opening the bales at their underside; a stationary support rack for receiving thereon a plurality of bales juxtapositioned in the working direction; and an arrangement for moving the breaker members as a unit back and forth in the working direction underneath the support rack for opening the underside of the bales juxtapositioned on the support rack. The latter has a plurality of parallel-spaced support rods extending in the working direction above the breaker members.

17 Claims, 10 Drawing Figures

APPARATUS FOR BREAKING TEXTILE FIBER BALES

BACKGROUND OF THE INVENTION

This invention relates to an apparatus for breaking textile fiber bales. The apparatus has at least two rotating breaker aprons or breaker rolls (hereafter designated as breaker members) which are arranged with a close spacing in series in the direction of their rotation (working direction) and which open a plurality of serially arranged textile fiber bales at their underside. The spikes of the breaker members are obliquely supported; the spikes of one breaker member are at an inclination which is oriented oppositely to the spikes of the other breaker member.

In a known bale breaking apparatus a series of textile fiber bales are moved back and forth by serially arranged, slightly spaced conveying means and, at the same time, the bales are opened at their underside. In such an apparatus, the breaker members serve simultaneously as the conveying means and the opening (breaking) means for the fiber bales. The latter therefore rest directly on the conveying means and are moved back and forth during the bale breaking operation. The number of conveying means corresponds approximately to that of the bales resting thereon. With such a simple bale breaking apparatus a high opening efficiency and mixing of the textile fiber bales can be achieved. In such a bale breaker apparatus, there are usually provided two parallel-spaced bale guiding walls which extend in the working direction (that is, in the direction of bale displacement) and which prevent a toppling of the bales in the lateral direction subsequent to the removal of the bale ties (at which time the bales usually become unstable). In the working direction, the bales are adjoined, at both sides, by equally unstable bales so that conditions may be present which could cause a bale to topple in the one or the other working direction.

SUMMARY OF THE INVENTION

It is an object of the invention to provide an improved apparatus of the above-outlined type in which the danger of bale toppling is eliminated and which is of economic structure.

These objects and others to become apparent as the specification progresses, are accomplished by the invention, according to which, briefly stated, for receiving the textile fiber bales there is provided a support rack formed of at least two rods extending in the working direction above the rotating breaker members which, in addition to their rotation, travel, as a unit, back and forth underneath the support rack.

In case breaker aprons are used in the apparatus according to the invention as outlined above, the parallel parts of the breaker apron belts are stationary during rotation, similarly to the caterpillars of a tracked vehicle. The belts and the spikes secured to the belts are moved only during the deflection about the end rolls. The obliquely oriented spikes situated on the stationary, parallel portions of the apron belts thus dwell in a stationary manner at the underside of the bale. Only during the semi-circular travel of the belt about the deflecting rolls (end rolls) are parts of the textile fiber bales removed by virtue of the downwardly flipping spikes.

In the apparatus designed according to the invention, the breaker members are, as noted above, movable back and forth and the textile fiber bales remain stationary on the fixedly supported rack during the opening process. During the opening operation, each spike projects through the intermediate space between the support rods and penetrates into the underside of the textile fiber bale, dwells at that location as long as the respective spike is moved downwardly as it moves about the deflecting roll. In this manner, the bales remain stationary and thus cannot topple in the working direction. It is a further advantage of this arrangement that it is sufficient to use only one pair of displaceable breaker members in order to open a plurality of juxtapositioned bales. This results in substantial structural economy. The stationary support rack too, may be manufactured very economically and with simple means. It is an additional advantage of the invention as outlined above that the bales somewhat bulge downwardly between the parallel bars. In this manner, in these locations, the outer face of the bales is somewhat expanded and slightly loosened so that a breaking operation by the spikes is facilitated. Further, it is another substantial advantage that the opening of the bales is effected at their underside. This zone, together with the conveying belt situated below the breaker members may be enclosed at all sides with simple arrangements, so that the closed space may be exposed in a suction stream for removing in a secure manner the dust generated during the bale breaking operation.

For securing the rods of the support rack in a ridge manner, there is advantageously provided a common transverse bar which extends generally horizontally and perpendicularly to the working direction. Expediently, the transverse bar is arranged at a distance above the rods of the support rack so that the spikes of the breaker members may project without obstruction into the intermediate space between the support rods.

The dimensions of the fiber tufts removed from the bales and delivered to the transport belt may be varied by altering the length of the spikes or, without re-tooling, by changing the distance between adjoining breaker members. The output rate of the apparatus may be altered by changing the rotational speed of the breaker members.

The breaker members are supported on a carriage displaceable along the machine frame in the working direction of the breaker members. In order to render the apparatus versatile, the speed of the carriage motion and the rotational speed of the breaker members may be steplessly changed. Expediently, the drives for the breaker members and the carriage may be connected to one another in such a manner that the rotational speed of the breaker members and the speed of the carriage are at least approximately identical. Such a coordination can be effected, for example, by a chain drive or a gear drive. The breaker members and the carriage may, however, each have its own drive motor. In case prior to the complete opening of the bales a bale replacement is to be effected, according to a preferred embodiment of the invention the entire support rack, including the bales, can be laterally shifted. Then, from the other side, another support rack, containing the new bales, may be laterally shifted into an operative position above the breaker members. Expediently, the support rack is formed of a plurality of laterally shiftable partial racks, so that even individual bales may be exchanged in a simple manner. This arrangement saves substantial manual or mechanical input which otherwise would be required for the removal and insertion of the replacement bales.

As the bales rest on the parallel bars of the support rack, the fibers are locally compressed in the zone of contact between rod and bale, so that they have the tendency to resist removal from the bale by the spikes of the breaker members. Accordingly, an advantageous feature of the invention provides that the bale can be easily opened even in the zone of the support bars on which the bale rests. In accordance with this embodiment, on the carriage which supports the breaker members, there are secured stripper elements (knives or teeth) which project into the intermediate space between the support rods. By providing that these stripper elements project into the intermediate space between the support rods, the underside of the textile fiber bales, particularly in the immediate vicinity of the rods, is torn open so that spikes of the breaker members work on already pre-loosened material. Further, above the rods unopened parts of the textile fiber bale may form a bridge which may tend to stiffen. By means of the stripper elements which work immediately adjacent and along the support rods, the bale material is laterally displaced in the zone of the bars, so that the solidified bridges may also be loosened and opened by the spikes of the breaker members. Preferably, the stripper elements are sharpened at their free ends to amplify their pre-loosening effect. For structural reasons, the stripper elements are located expediently in the zone where the breaker members are deflected about the end rolls.

In practice, several stripper elements are arranged next to one another, that is, perpendicularly to the working direction. Expediently, for example, three rows of stripper elements are provided, that is, in front of, between and behind the breaker members as viewed in the working direction. According to a preferred embodiment, the stripping elements arranged behind one another when viewed in the working direction are situated at different sides of the support rods. In this manner, the bale is worked alternatingly from two different sides in the zone of the support rods, whereby the bale material is shifted laterally, thus permitting the loosening of stiffened bridge formations by the spikes of the breaker members.

BRIEF DESCRIPTION OF THE DRAWINGS

FIG. 2*a* is a side elevational view of a detail of FIG. 2, including a distance-adjusting arrangement.

DESCRIPTION OF THE PREFERRED EMBODIMENTS

Figure 1:
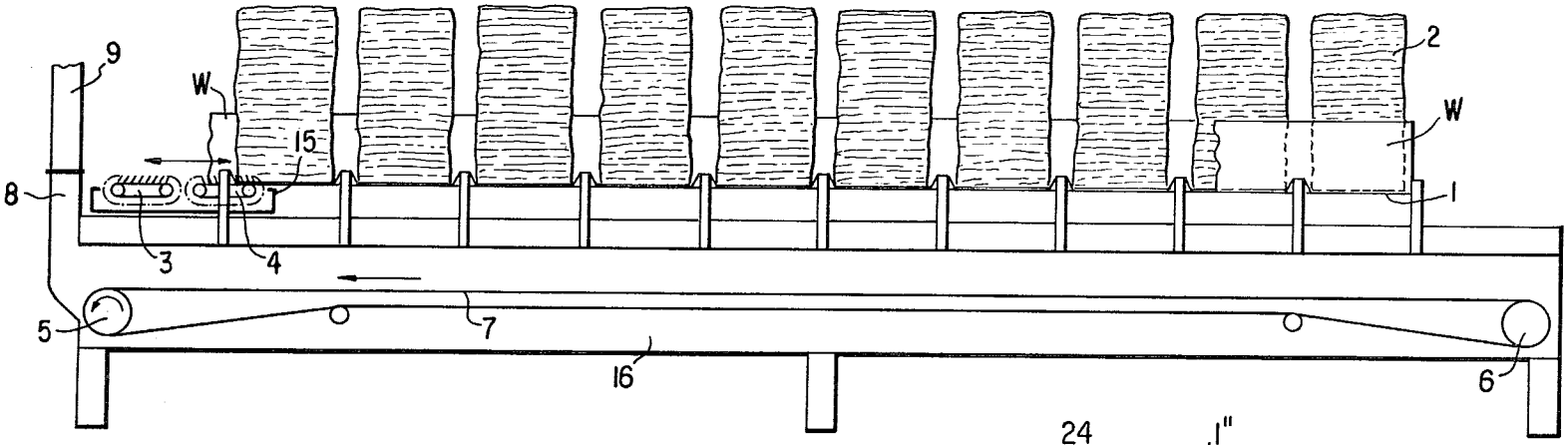
FIG. 1 is a schematic side elevational view of a preferred embodiment of the invention.

Turning now to FIG. 1, there is shown a support rack 1 on which there is positioned a series of ten bales 2. Underneath the support rack 1, there are arranged two breaker aprons 3 and 4, the length of which approximately corresponds to the length of one bale. Underneath the breaker aprons 3 and 4 there are situated two rolls 5 and 6 about which there is trained a rotating transport belt 7. At one terminus of the belt 7, there is arranged a suction funnel 8 leading to a suction conduit 9.

Figure 2:
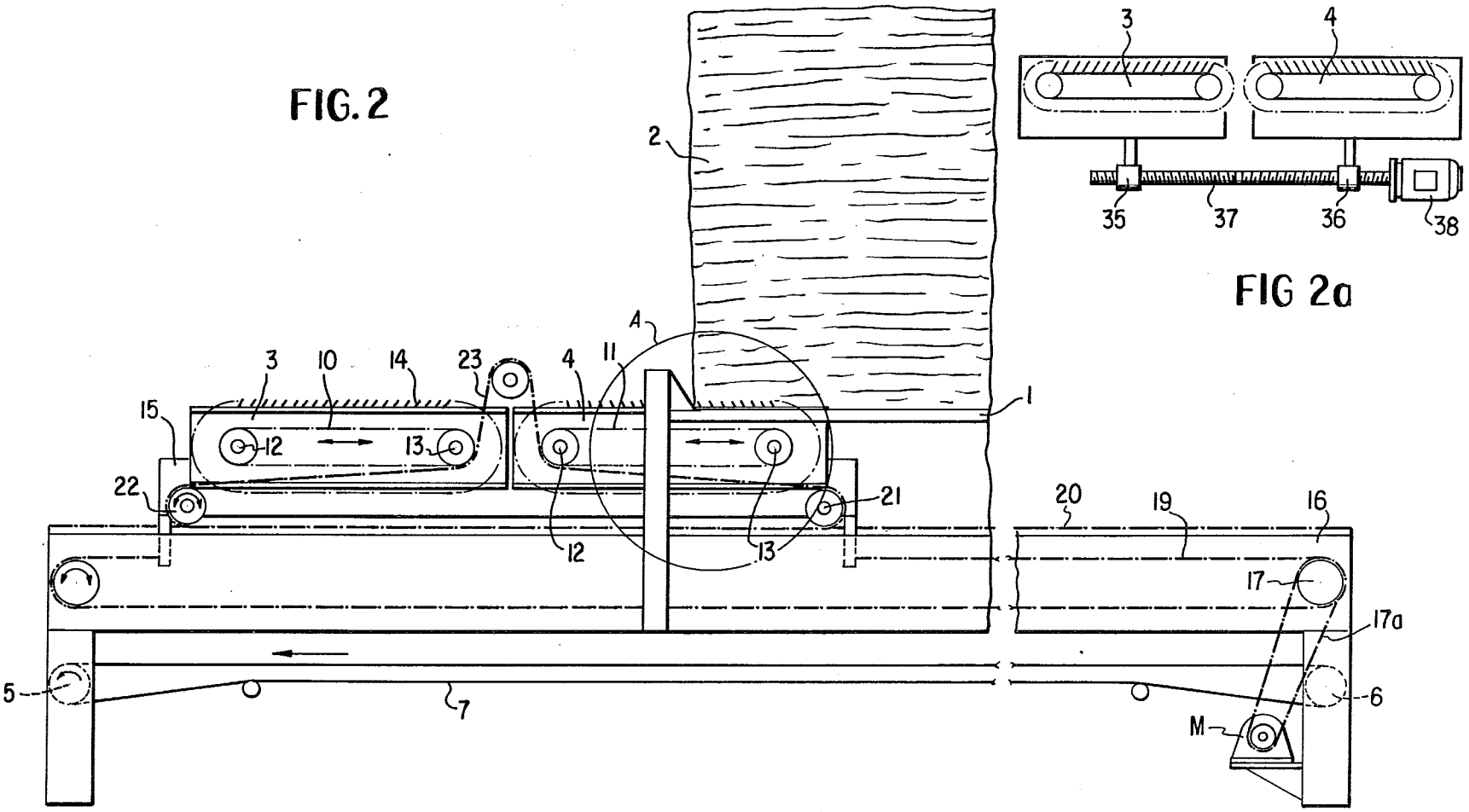
FIG. 2 is a schematic side elevational view of a detail of FIG. 1 on an enlarged scale.

Also turning now to FIG. 2, each breaker apron 3 and 4 is formed of a respective endless belt 10 and 11, the width of which is somewhat greater than the width of each bale. Each breaker apron further has a driven roll 12 and an idling roll 13 about which the respective belt 10 or 11 is trained. The rotational direction of the rolls 12, 13 as well as their rotational speed may be varied. The belt 10 or 11 is provided with a plurality of spikes 14, the length of which is approximately 35 mm. Each spike 14 is at an oblique inclination with respect to the belts 10 and 11. Further, the spikes of the belt 11 have an oblique orientation which is opposite to that of the spikes supported on the belt 11. The distance between adjoining breaker aprons 3 and 4 may be steplessly varied by a relative shift of the breaker aprons 3 and 4 with respect to one another. In this connection reference is made to FIG. 2*a* which illustrates such a distance-adjusting device for the breaker aprons 3 and 4. Nuts 35 and 36 which are fixedly attached to the breaker aprons 3 and 4, respectively, threadedly engage a common spindle 37. The latter is driven by a motor 38. The nut 35, as well as the spindle zone associated therewith have a matching left-hand thread, while the nut 36 as well as the spindle zone associated therewith have a matching right-hand thread. Thus, dependent upon the direction in which the motor 38 is rotated, the breaker aprons 3 and 4 are moved towards or away from one another. The breaker aprons 3 and 4 are mounted on a carriage 15 which, in turn, is displaceably supported on the frame 16 of the apparatus. The carriage 15 is driven by a chain 19 trained about two sprockets 17 and 18. Into a further chain 20, secured to the frame 16, there project gears 21 and 22 which are rotatably mounted on the carriage 15. The gears 21 and 22 simultaneously drive, through a chain 23, the drive rolls 12 and 13 of the respective breaker aprons 3 and 4. In this manner, the drive of the carriage 15 and the drive of the breaker aprons 3 and 4 are connected to one another so that a positive drive is effected between the traveling movement of the carriage 15 and the rotation of the belts 10 and 11. The entire drive chain arrangement may be driven by a sole motor M, whose speed is preferably steplessly variable and which drives the roll 17 by the intermediary of a chain 17*a*.

Figure 3:
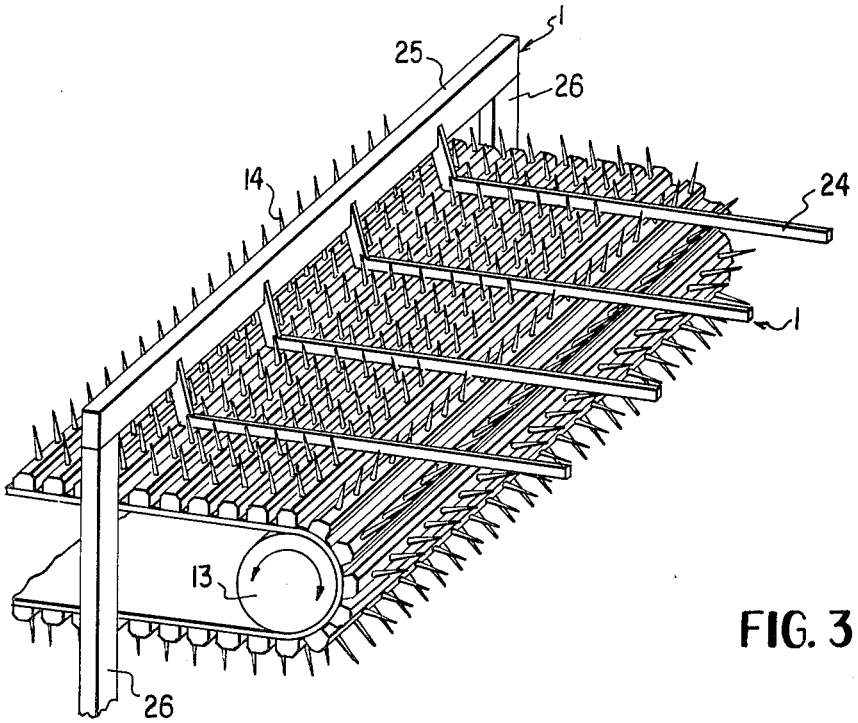
FIG. 3 is a perspective view of detail A of FIG. 2.

As illustrated in FIG. 3, the support rack 1 is formed of a plurality of parallel-spaced support rods 24 extending in the working direction and attached to a transverse bar 25 which, in turn, extends generally horizontally and perpendicularly to the working direction. The transverse bar 25 is situated above and spaced from the support rods 24 and is itself supported by uprights 26 arranged on either side of the breaker aprons.

After depositing, for example, ten bales 2 on the support rack 1, the two breaker aprons 3 and 4 are driven with identical speed and in the same direction. The spikes 14 project through the spacing between the rods 24 of the support rack 1 (as illustrated in FIG. 3) into the bales 2. Simultaneously, the carriage 15, on which the breaker aprons 3 and 4 are mounted, is driven with the same speed as the breaker aprons 3 and 4. The bales 2 remain stationary on the rods 24 of the support rack 1 and are laterally supported by lateral bale supporting walls W arranged on both sides of the support rack 1 and extending in a vertical orientation, in the working direction. Since the spikes 14 of the breaker apron 3, as they emerge from a bale, move downwardly with a substantially greater speed by virtue of the deflection of the belt 10, they tear, from the bale, small fiber tufts which drop on the transport belt 7. As soon as the leading breaker apron 4 reaches the end of the last bale 2, the drive of the rolls of the carriage 15 and the breaker aprons 3 and 4 is reversed. This may be effected, for example, by a photocell arrangement or by a limit switch. The breaker aprons 3 and 4 move then in the opposite direction underneath the bales 2 lying on the support rack 1, at which time then the spikes 14 of the breaker apron 4 tear, from the underside of the bales 2, fiber tufts which drop on the transport belt 7. When the now leading breaker apron 3 has reached the end of the last bale 2, the drive of the breaker aprons 3 and 4 is again reversed. The fiber tufts received on the transport belt 7 are drawn through the suction funnel 8 into the conduit 9 and are then advanced therefrom to the next processing station. The size of the fiber tufts falling onto the transport belt 7 may be varied by changing the spikes 14 and/or by changing the distance between the breaker aprons 3 and 4. The output rate of the apparatus may be varied by changing the rotational speed of the breaker aprons 3 and 4, for example, by varying the speed of the motor M.

Figure 9:
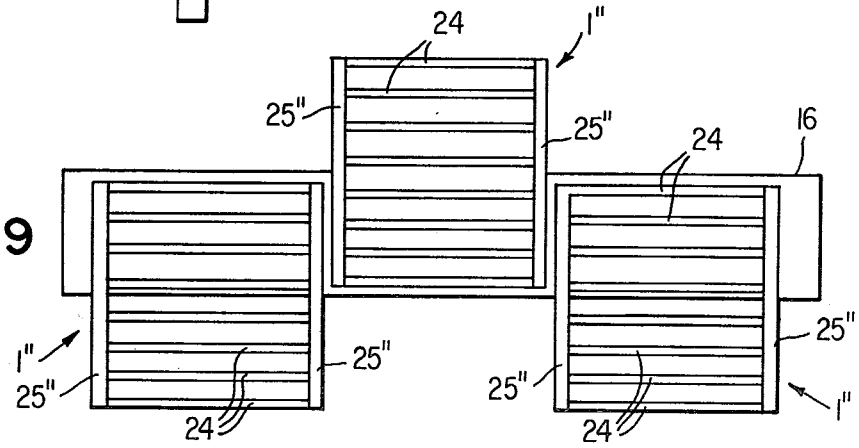
FIG. 9 is a schematic top plan view of a laterally displaceable sectional support rack according to the invention.
Figure 4:
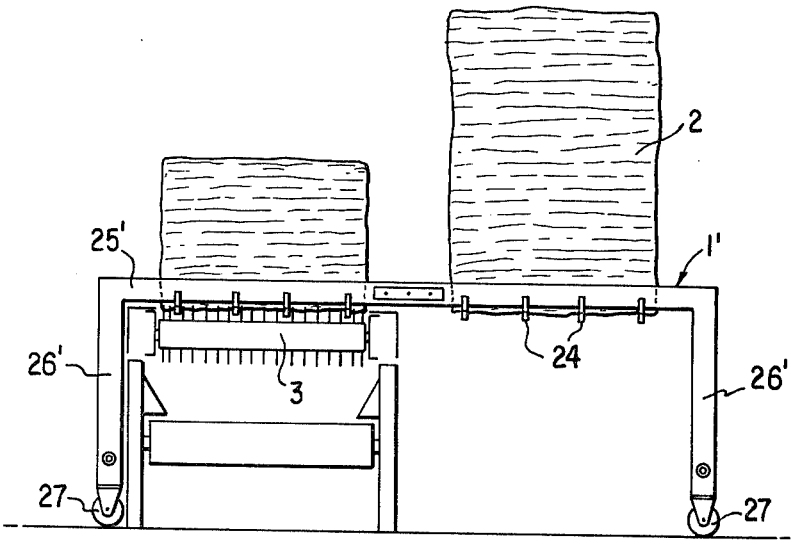
FIG. 4 is a schematic cross-sectional front elevational view of a laterally displaceable support rack according to the invention.

Also turning now to FIG. 4, the support rack 1 shown therein is formed of a transverse bar 25' which extends laterally beyond the width of the breaker aprons 3 as well as eight parallel-spaced support rods 24 which are secured to the transverse bar 25' and which extend in the working direction of the breaker aprons 3 and 4. The transverse bar 25' is attached to uprights 26' on either side of the breaker aprons 3 and 4. The uprights are movable on the floor by means of wheels 27, so that the entire support rack, together with the bales placed thereon, is displaceable horizontally and perpendicularly to the working direction of the breaker aprons 3 and 4. Each bale is supported on four support rods 24 so that a standby bale may be positioned next to the bale being opened and then, when desired, the support rack may be shifted to align the standby bale series with the breaker aprons 3 and 4. Thus, expediently, the width of the support rack is at least twice the width of the breaker aprons 3 and 4 (measured in a horizontal direction perpendicularly to the working direction). In this manner, a rapid bale replacement may take place. By longitudinally sectionally connecting the support racks to one another it is feasible to effect a bale replacement while other bales behind and in front of the moved rack section remain in place. Thus, for this purpose, as seen in FIG. 9, the support rack is formed of a plurality of partial support racks 1". Each partial support rack 1", in turn, is formed of two transverse bars 25", and, for example, eight support rods 24 connected to the two transverse bars 25". The partial support racks 1" are arranged behind one another as viewed in the working direction and are individually displaceable in the lateral direction by rolling them on wheels (not shown in FIG. 9).

Figure 5:
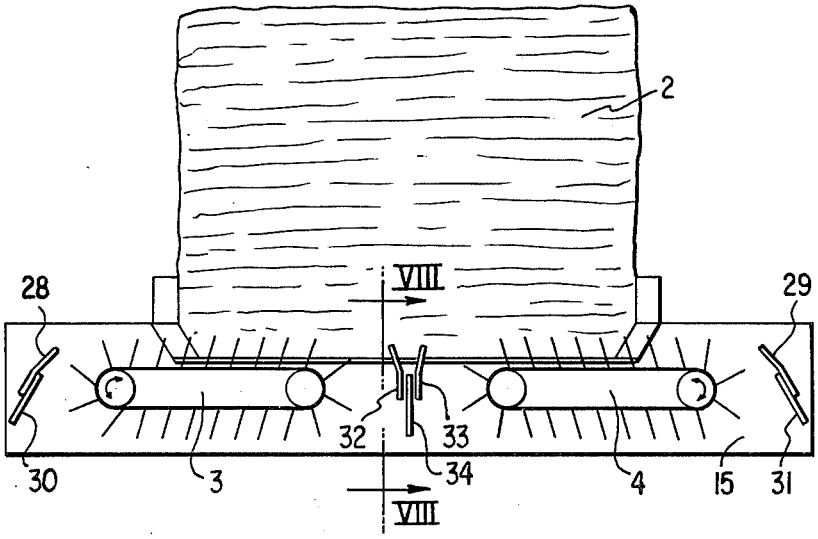
FIG. 5 is a schematic side elevational view of the invention, including stripper elements.

Turning now to FIG. 5, at the two ends (as viewed in the working direction) of the breaker members 3 and 4 considered as a unit there are provided, in the zone of deflection, stripper knives 28 and 29 secured to respective holders 30 and 31 which, in turn, are mounted on the carriage 15. Further, between the slat tables of the aprons 3 and 4, there are provided additional knives 32 and 33 supported on a holder 34 also secured to the carriage 15. The holders 30, 31 and 34, the stripper knives 28, 29, 32 and 33 and the breaker aprons 3 and 4 move as a unit with the carriage 15.

Figure 6:
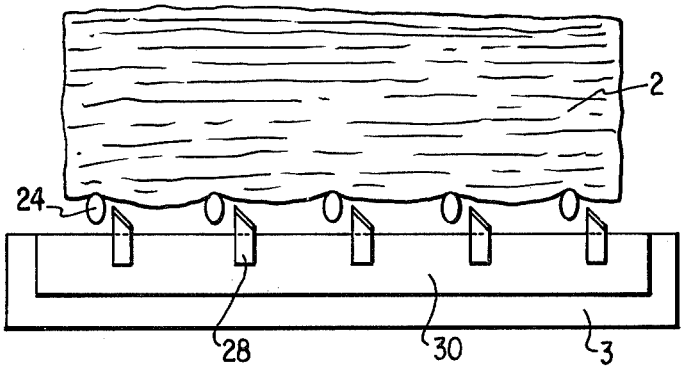
FIGS. 6 and 7 are respective front and rear elevational views of the structure shown in FIG. 5.

FIG. 6 is a front elevational view of the location of deflection of the breaker apron 3. On the holder 30, there are arranged in juxtaposition, for example, five stripper knives 28 immediately adjacent the support rods 24.

Figure 7:
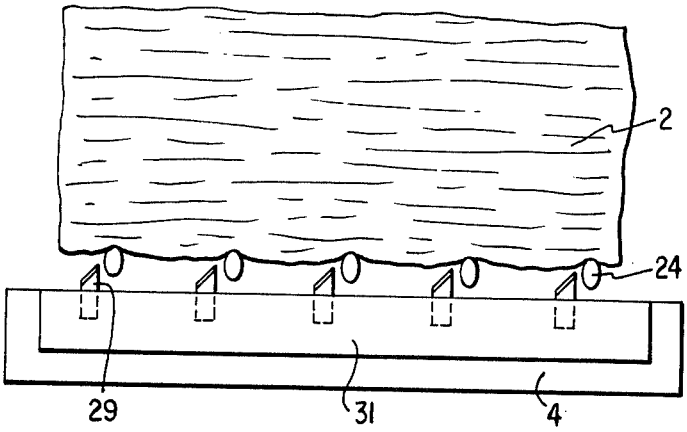

FIG. 7 shows a rear elevational view of the locations of deflection of the breaker apron 4. On the holder 31, there are secured in a juxtaposition, for example, four stripper knives 29 immediately adjacent the rods 24.

Figure 8:
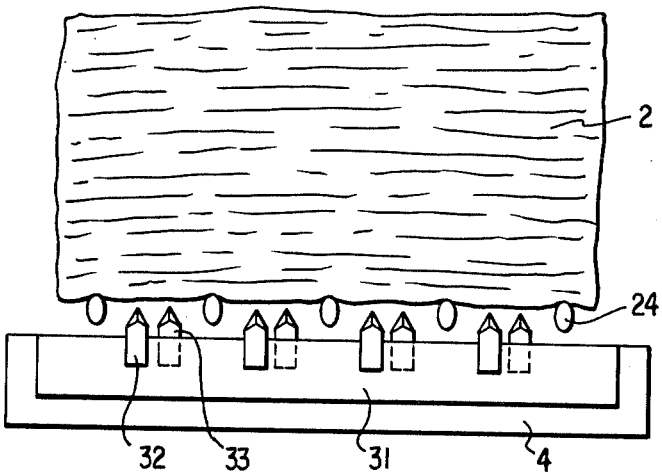
FIG. 8 is a sectional view taken along line VIII—VIII of FIG. 5.

Turning now to FIG. 8, there is shown the holder 34 which is situated in the intermediate space between the locations of deflection of the breaker aprons 3 and 4. While the stripper knife 32 associated with the breaker apron 3 operates at one side of the associated support rod 24, the stripper knives 33 cooperating with the breaker apron 4 work on the bale at the other side of the associated support rod 24.

It will be understood that the above description of the present invention is susceptible to various modifications, changes and adaptations, and the same are intended to be comprehended within the meaning and range of equivalents of the appended claims.

What is claimed is:

1. In an apparatus for breaking textile fiber bales, including at least two spiked breaker members rotated in the working direction for opening the bales at their underside; the improvement comprising (a) a stationary support rack for receiving thereon a plurality of bales juxtapositioned in the working direction; said support rack having a plurality of parallel-spaced support rods extending in the working direction above said breaker members;

(b) means for moving said breaker members as a unit back and forth in the working direction underneath said support rack for opening the underside of the bales juxtapositioned on said support rack; and (c) means providing for a displaceability of said support rack in a horizontal direction transversely to said working direction out of the operational range of said breaker members.

2. In an apparatus for breaking textile fiber bales at their underside, including at least one support rod extending in the length dimension of the apparatus for receiving thereon a plurality of bales juxtapositioned in the direction of the apparatus length; a carriage mounted on a frame of the apparatus for displacement back and forth in the direction of the apparatus length, and breaker means mounted on the carriage for engaging the underside of the bales for opening the bales at their underside; the improvement wherein said breaker means includes at least one spiked apron and further comprising driving means for displacing said carriage and rotating said spiked apron at least approximately with the same speeds in the direction of the apparatus length.

3. An apparatus as defined in claim 2, wherein said drive means is a single motor drivingly connected to said carriage and said spiked apron.

4. An apparatus as defined in claim 2, further comprising a stationary support rack having a plurality of parallel-spaced support rods for receiving the bales thereon; and lateral bale support walls extending in a vertical orientation along opposite sides of said support rack in the direction of the apparatus length.

5. An apparatus as defined in claim 2, further comprising a stationary support rack having a plurality of parallel-spaced support rods for receiving the bales thereon; said support rack further having a transverse bar extending generally horizontally and perpendicularly to the direction of the apparatus length; said support rods being rigidly affixed to said transverse bar.

6. An apparatus as defined in claim 5, wherein said transverse bar is situated above and spaced from said support rods.

7. In an apparatus for breaking textile fiber bales at their underside, including at least one support rod extending in the length dimension of the apparatus for receiving thereon a plurality of bales juxtapositioned in the direction of the apparatus length; a carriage mounted on a frame of the apparatus for displacement back and forth in the direction of the apparatus length, and breaker means mounted on the carriage for engaging the underside of the bales for opening the bales at their underside; the improvement wherein said breaker means includes two spiked aprons spaced from one another in the direction of the apparatus length; and further comprising driving means for displacing said carriage and rotating said spiked aprons at least approximately with the same speeds in the direction of the apparatus length; and means for steplessly varying the distance between said spiked aprons.

8. In an apparatus for breaking textile fiber bales at their underside, including at least one support rod extending in the length dimension of the apparatus for receiving thereon a plurality of bales juxtapositioned in the direction of the apparatus length; a carriage mounted on a frame of the apparatus for displacement back and forth in the direction of the apparatus length, and breaker means mounted on the carriage for engaging the underside of the bales for opening the bales at their underside; the improvement wherein said breaker means includes at least one spiked apron and further comprising driving means for displacing said carriage and rotating said spiked apron at least approximately with the same speeds in the direction of the apparatus length; said driving means including means for steplessly varying the speed of displacement of said carriage and the rotational speed of said spiked apron.

9. In an apparatus for breaking textile fiber bales, including at least two spiked breaker members rotated in the working direction for opening the bales at their underside; the improvement comprising (a) a stationary support rack for receiving thereon a plurality of bales juxtapositioned in the working direction; said support rack having a plurality of parallel-spaced support rods extending in the working direction above said breaker members;

(b) means for moving said breaker members as a unit back and forth in the working direction underneath said support rack for opening the underside of the bales juxtapositioned on said support rack; and (c) means providing for a displaceability of said support rack in a horizontal direction transversely to said working direction out of the operational range of said breaker members; said support rack being at least twice as wide as the width of said breaker members for accommodating at least two bales in a side-by-side relationship in a direction parallel to said direction of displaceability of said support rack.

10. An apparatus as defined in claim 9, wherein said support rack is formed of a plurality of detachable support rack sections arranged in a series in said working direction.

11. An apparatus as defined in claim 9, wherein said support rack has a plurality of uprights extending downwardly at opposite sides of said breaker members; and horizontal transverse bars extending parallel to the width dimension of said members aprons and carrying said support rods; said transverse bars being affixed to said uprights.

12. An apparatus as defined in claim 11, wherein said means providing for a displaceability of said support rack comprises floor-engaging wheels mounted on lower ends of said uprights to provide for a rolling displaceability of said support rack.

13. In an apparatus for breaking textile fiber bales, including at least two spiked aprons spaced from one another in the direction of the apparatus length for opening the bales at their underside; the improvement comprising (a) a stationary support rack for receiving thereon a plurality of bales juxtapositioned in said direction; said support rack having a plurality of parallel-spaced support rods extending in said direction above said breaker members;

(b) a carriage mounted on a frame of the apparatus for displacement in said direction; said spiked aprons being mounted on said carriage for being moved as a unit back and forth parallel to said direction underneath said support rack for opening the underside of the bales juxtapositioned on said support rack;

(c) a plurality of stripper elements affixed to said carriage and projecting upwardly into said support rack between said support rods; and (d) driving means for displacing said carriage and rotating said spiked aprons at least approximately with the same speeds in the direction of the apparatus length.

14. An apparatus as defined in claim 13, wherein said stripper elements are arranged immediately adjacent said support rods.

15. An apparatus as defined in claim 13, wherein said stripper elements have sharpened free ends.

16. An apparatus as defined in claim 13, wherein a plurality of said stripper elements are arranged at each opposite end of each said spiked apron as viewed in said direction.

17. An apparatus as defined in claim 16, wherein said stripper elements are arranged alternatingly adjacent the one and the other side of said support rods as viewed in said direction.

* * * * *

UNITED STATES PATENT AND TRADEMARK OFFICE

CERTIFICATE OF CORRECTION

PATENT NO. : 4,192,042

DATED : March 11, 1980

INVENTOR(S) : Peter Jagst

It is certified that error appears in the above-identified patent and that said Letters Patent are hereby corrected as shown below:

In the heading of the patent, under [30] Foreign Application Priority Data, change "Jul. 20, 1977 [DE] Fed. Rep. of Germany 2732729" to --Mar. 12, 1977 [DE] Fed. Rep. of Germany 2710891--.

Signed and Sealed this

*Twenty-second* Day of *July 1980*

[SEAL]

*Attest:*

SIDNEY A. DIAMOND

*Attesting Officer*

*Commissioner of Patents and Trademarks*